US006139299A

United States Patent [19]

Kumar et al.

[11] Patent Number: 6,139,299

[45] Date of Patent: Oct. 31, 2000

[54] CONJUGATE SCREW ROTOR PROFILE

[75] Inventors: Keshava B. Kumar, Manlius; James W. Bush, Skaneateles, both of N.Y.

[73] Assignee: Carrier Corporation, Syracuse, N.Y.

[21] Appl. No.: 09/087,576

[22] Filed: May 29, 1998

[51] Int. Cl.[7] ..... F01C 1/16

[52] U.S. Cl. ..... 418/201.3; 418/150

[58] Field of Search ..... 418/150, 201.3

[56] References Cited

U.S. PATENT DOCUMENTS

Re. 32,568 12/1987 Astberg .
3,314,598 4/1967 Lysholm ..... 418/150
3,932,073 1/1976 Schibbye et al. ..... 418/203 X
5,207,568 5/1993 Szymaszek ..... 418/203

*Primary Examiner*—Hoang Nguyen

[57] ABSTRACT

The point of tangency of the tip circle of the male rotor and the root circle of the female rotor is used as a starting point in generating the series of curves defining the male and female conjugate rotor profiles. The present invention provides: reduced viscous drag through the use of a departure angle; strengthened female lobes by controlling thickness along the pitch circle; opened root of male rotor to enhance manufacturability and tool life; a tortuous leakage path for gas traveling from a high pressure thread to a low pressure thread; better control of root diameter; and control of the pressure angle independently of the other variables.

47 Claims, 8 Drawing Sheets

CONJUGATE SCREW ROTOR PROFILE

BACKGROUND OF THE INVENTION

While there is some commonality between gears and screw rotors, a major difference is in the fluid sealing requirements of screw rotors. As in the case of gears, screw rotors have pitch circles which represent locations of equal tangential velocity for conjugate pairs of rotors. The spiral grooves in the rotors are the locations of the volumes of gas which are trapped and compressed due to the coaction of a conjugate pair of rotors and an enclosing casing. Accordingly, the volumes of the spiral grooves are a major design consideration with their width, depth, length and number being design variables. The shape of the cross section of the spiral grooves includes the variables of width and depth as well as the shape requirements for the driving/driven coaction between the conjugate pair of rotors. Additionally, the conjugate pair must meet the sealing requirements as the line contact advances along the rotor profile in the driving/driven coaction and as the rotor tips and end faces coact with the enclosing casing. This line contact follows the perimeters of the rotor profiles and is therefore at a varying tangential speed and has significant radial components. Additionally, the shape and cross section of the spiral grooves must meet requirements for ease of manufacture and cutting tool life. One problem associated with conventional screw rotor designs is that the pressure angle and lobe thickness are interrelated. It is desirable to minimize the pressure angle, the angle of contact between the rotors in the contact zone near or at the pitch circle, to provide reduced contact loading. However, the reducing of the pressure angle has an attendant undesirable reduction in lobe thickness such that conventional designs represent a compromise between desired pressure angle and desired lobe thickness.

Assuming that each respective lobe tip of each rotor is in tangential contact with a root of the other rotor during a point in each revolution, the addendum of the lobes of one rotor will be coincident to the dedendum of the lobes of the other rotor as measured along a line connecting the centers of the two rotors. Ignoring running clearances, machining tolerances, wear, thermal expansion, etc. there are three nominal points of tangency between a conjugate pair of rotors, namely between the pitch circles and between the tip circle of each rotor and the root circle of the other rotor.

SUMMARY OF THE INVENTION

The present invention is directed to an improved configuration for a conjugate pair of screw rotors. Among the benefits provided by the present invention are: reduced viscous drag through the use of a departure angle; strengthened female lobes by controlling thickness along the pitch circle; opened root of male rotor to enhance manufacturability and tool life; a tortuous flow path for gas leaking from a high pressure thread; better control of root diameter; and control of the pressure angle independently of the other variables.

It is an object of this invention to increase the efficiency of a screw machine.

It is another object of this invention to provide conjugate screw rotor profiles having reduced leakage.

It is a further object of this invention to achieve the disclosed performance based objects while improving the manufacturability of the screw rotor profiles. These objects, and others as will become apparent hereinafter, are accomplished by the present invention.

Basically, the point of tangency of the tip circle of the male rotor and the root circle of the female rotor is used as a starting point in generating the series of curves defining the male and female conjugate rotor profiles. Additionally, the pressure angle is independent of the female lobe thickness.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
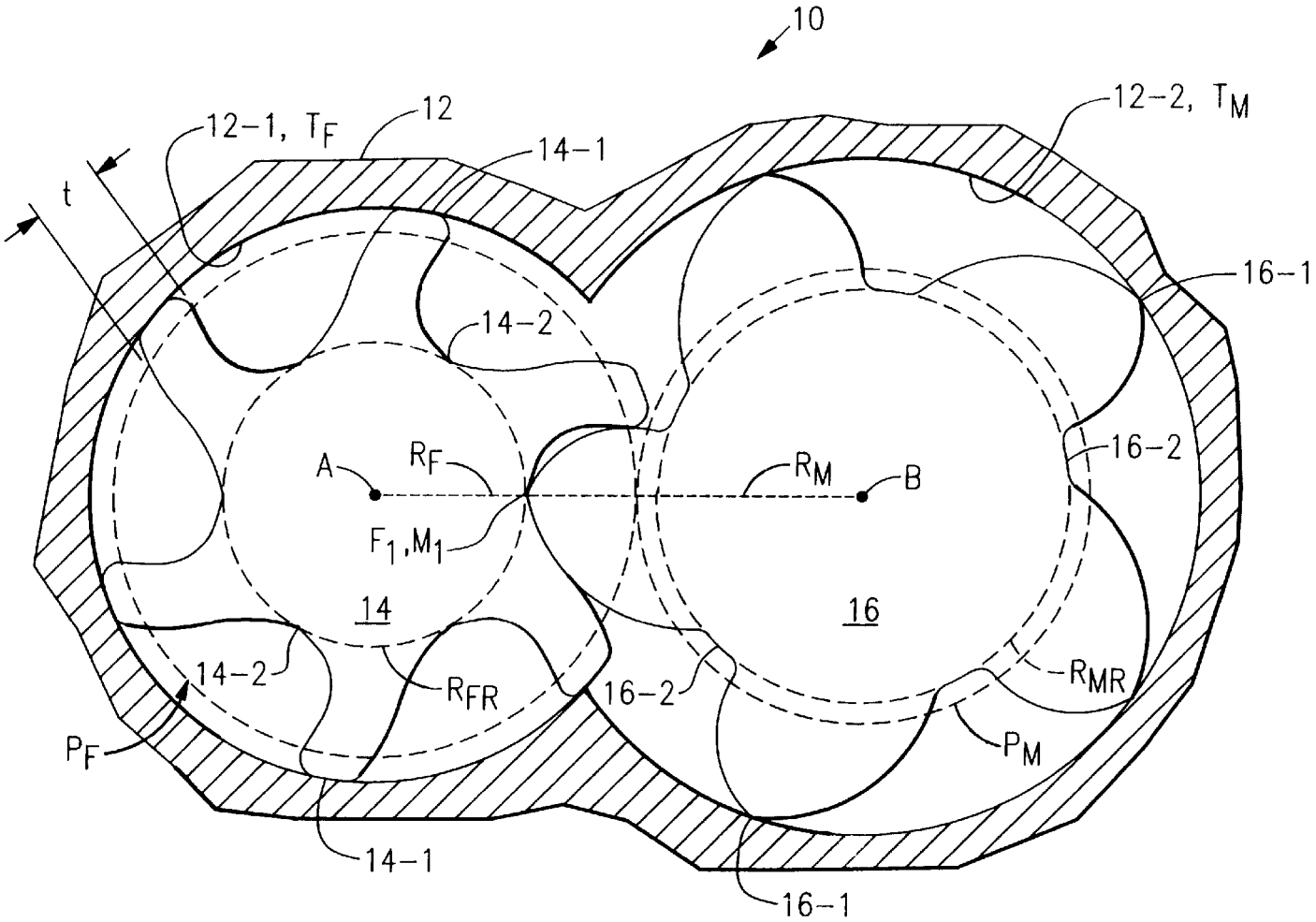
FIG. 1 is a transverse suction through a screw machine employing the present invention.

In FIG. 1, the numeral 10 generally indicates a screw machine such as a screw compressor. Screw machine 10 has a casing 12 with overlapping bores 12-1 and 12-2 located therein. Female rotor 14 has a pitch circle, $P_F$, and is located in bore 12-1. Male rotor 16 has a pitch circle, $P_M$, and is located in bore 12-2. The axes indicated by points A and B are perpendicular to the plane of FIG. 1 and are parallel to each other and are separated by a distance equal to the sum of the radius, $R_F$, of the pitch circle, $P_F$, of female rotor 14 and the radius, $R_M$, of the pitch circle, $P_M$, of male rotor 16. The axis indicated by point A is the axis of rotation of female rotor 14 and the center of bore 12-1 whose diameter generally corresponds to the diameter of the tip circle, $T_F$, of female rotor 14. Similarly, the axis indicated by point B is the axis of rotation of male rotor 16 and the center of bore 12-2 whose diameter generally corresponds to the diameter of the tip circle, $T_M$, of male rotor 16. Neglecting operating clearances, the extension of the bore 12-1 through the overlapping portion with bore 12-2 will intersect line A-B at the tangent point with the root circle, $R_{MR}$, of male rotor 16. Similarly, the extension of the bore 12-2 through the overlapping portion with bore 12-1 will intersect line A-B at the tangent point with the root circle, $R_{FR}$, of female rotor 14 and this common point is labeled $F_1$ relative to female rotor 14 and $M_1$ relative to male rotor 16.

As illustrated, female rotor 14 has six lands, 14-1, separated by six grooves, 14-2, while male rotor 16 has five lands, 16-1, separated by five grooves 16-2.

Accordingly, the rotational speed of rotor 16 will be ⅚ or 120% of that of rotor 14. Either the female rotor 14 or the male rotor 16 may be connected to a prime mover (not illustrated) and serve as the driving rotor. Other combinations of the number of female and male lands and grooves may also be used.

Figure 2:
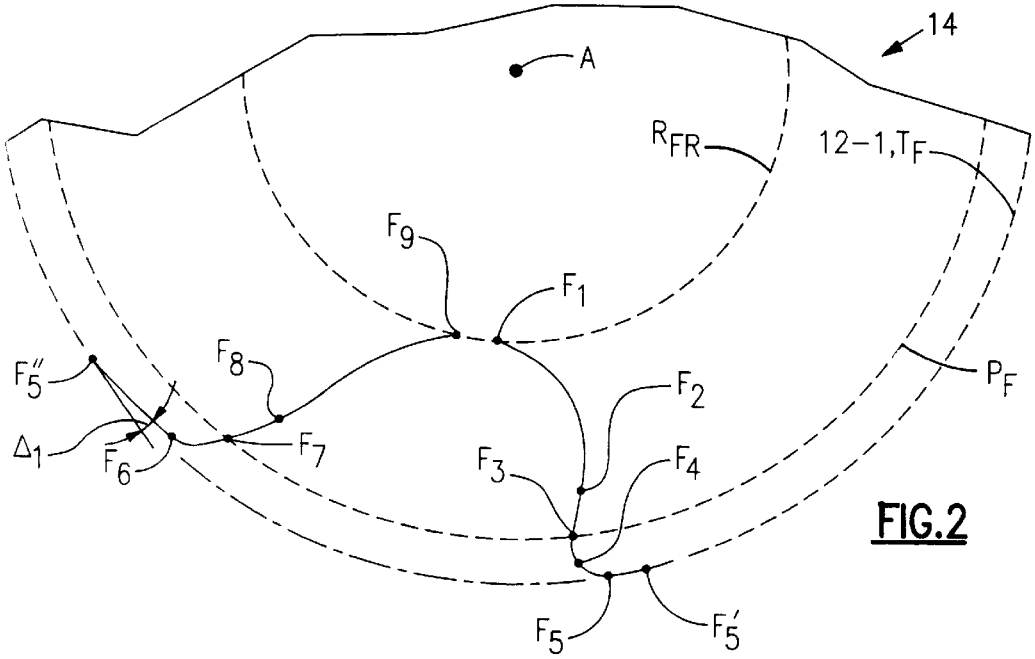
FIG. 2 is a plot of the curve segments making up the female rotor.
Figure 3:
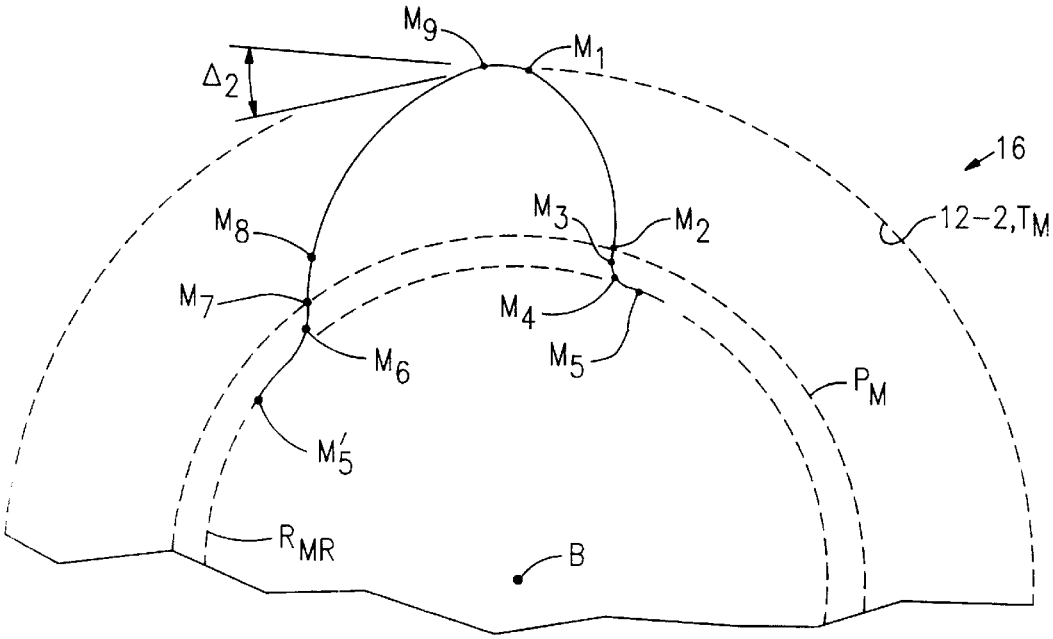
FIG. 3 is a plot of the curve segments making up the male rotor.

The generation of the profiles of rotors 14 and 16 startsn with common point, $F_1$, $M_1$, as shown in FIG. 1. With reference to FIGS. 1–3, the curve $F_1$–$F_2$ on female rotor 14 is generated by point $M_1$ on the male tip as it rotates about axis B with both of rotors 14 and 16 having the same pitch circle velocity. Curve $F_1$–$F_2$ extends from the root of female rotor 14 to a point, $F_2$, short of the female pitch circle, $P_F$.

Curve $F_2$–$F_3$ is a circular arc on female rotor 14 and extends from point $F_2$ to the pitch circle $P_F$. The center of curve $F_2$–$F_3$ is positioned such that curve $F_2$–$F_3$ both intersects curve $F_1$–$F_2$ and is tangent to curve $F_1$–$F_2$ at the point of intersection. The radius of curve $F_2$–$F_3$ is adjusted to provide a desired balance between minimum blow hole area, as it affects the angle at which curve $F_3$–$F_4$ intersects the pitch circle $P_F$, described below, and ease of manufacturing since tool life decreases with a reduction in the radius of curve $F_2$–$F_3$.

Curve $F_2$–$F_3$ generates curve $M_1$–$M_2$ on male rotor 16. As noted above, point $M_1$ generates curve $F_1$–$F_2$ so that $F_2$ is a common point with point $M_1$ at one point in the rotation of the rotors. Curve $M_1$–$M_2$ represents the path swept out on male rotor 16 by curve $F_2$–$F_3$ as contact advances from $F_2$ to $F_3$ while both of rotors 14 and 16 are rotating at the same pitch circle velocity.

The curve $F_3$–$F_4$ is a circular arc on female rotor 14 and its length or angular range is adjusted such that the male portion it generates, $M_2$–$M_3$, falls inside the pitch circle, $P_M$, of male rotor 16. The center of curve $F_3$–$F_4$ is positioned such that curve $F_3$–$F_4$ both intersects curve $F_2$–$F_3$ and is tangent to curve $F_2$–$F_3$ at the point of intersection. Curve $F_3$–$F_4$ influences the blow hole area, which is a leakage area defined by the cusp between bores 12-1 and 12-2 and rotors 14 and 16, and by minimizing the blow hole area, the leakage area, and therefore the leakage, is reduced which helps to improve the efficiency of screw machine 10. The radius of curve $F_3$–$F_4$ is adjusted to provide a desired balance between minimum blow hole area and ease of manufacturing.

Curve $M_2$–$M_3$ is generated by curve $F_3$–$F_4$ on the female rotor 14 and represents the clearance path swept out on male rotor 16 by curve $F_3$–$F_4$ as contact advances from $F_3$ to $F_4$ while both of rotors 14 and 16 are rotating at the same pitch circle velocity.

The curve $F_4$–$F_5$ on female rotor 14 is a circular arc extending from point $F_4$ to its intersection with the tip circle $T_F$ (bore 12-1) at point $F_5$. The radius and position of curve $F_4$–$F_5$ is adjusted so that curve $F_4$–$F_5$ is both coincident with and tangent to curve $F_3$–$F_4$ at the point of intersection, $F_4$, and so that it is tangent to the tip circle $T_F$ (bore 12-1) at point $F_5$.

Curve $M_3$–$M_4$ on the male rotor is generated by curve $F_4$–$F_5$ and represents the path swept out on male rotor 16 by curve $F_4$–$F_5$ as contact advances from $M_3$ to $M_4$ while both of rotors 14 and 16 are rotating at the same pitch circle velocity.

Curve $F_5$–$F_5'$ is a circular arc extending along the tip circle $T_F$ (bore 12-1) of female rotor 14. Curve $F_5$–$F_5'$ generates curve $M_4$–$M_5$ as contact advances from $F_5$–$F_5'$ while both of rotors 14 and 16 are rotating at the same pitch circle velocity. Since curve $F_5$–$F_5'$ is a circular arc on the tip circle $T_F$ (bore 12–1) of the female rotor 14 and is thus centered on the female rotor center A, the resulting curve $M_4$–$M_5$ is also a circular arc which is centered on the male rotor center B and which is the root circle $R_{MR}$ of male rotor 16. These qualities of $M_4$–$M_5$ make it particularly suited for easy generation and inspection and provides better control of the male root for manufacturability.

Points $F_5''$ and $M_5'$ correspond to points $F_5'$ and $M_5$, respectively, located on an adjacent rotor lobe face and will be used as starting points for describing the other portions of the profiles of rotors 14 and 16. Straight line, or curve of infinite radius, $F_5''$–$F_6$ extends from $F_5''$ on the tip of female rotor 14 at an angle, $\Delta_1$, with respect to a tangent at female tip circle $T_F$ (bore 12-1) at $F_5''$. Line $F_5''$–$F_6$ extends to a point short of the female pitch circle $P_F$. The angle $\Delta_1$ is the female rotor departure angle and it provides the benefit of reducing viscous drag.

Curve $M_5'$–$M_6$ on male rotor 16 is generated by line $F_5''$–$F_6$ and represents the path swept out on male rotor 16 by line $F_5''$–$F_6$ as contact advances from $M_5'$to $M_6$ while both of rotors 14 and 16 are rotating at the same pitch circle velocity.

Curve $F_6$–$F_7$ is a circular arc on female rotor 14. Line $F_5''$–$F_6$ and curve $F_6$–$F_7$ coact to: (1) control the thickness, t, of the lobes of female rotor 14 as measured along the pitch circle, $P_F$, and which is controlled to maintain stiffness of the female lobe tip 14-1 to reduce deflection during machining; (2) to provide sufficient room at the base 16-2 of the male lobe so that a large, strong cutting tool may be used to improve the accuracy and speed of machining; and (3) to make the leak path more tortuous.

Curve $M_6$–$M_7$ on male rotor 16 is generated by curve $F_6$–$F_7$ and represents the path swept out on male rotor 16 by curve $F_6$–$F_7$ as contact advances from $M_6$ to $M_7$ while both of rotors 14 and 16 are rotating at the same pitch circle velocity.

Curve $M_7$–$M_8$ on male rotor 16 is an involute of a circle at the desired pressure angle. The male pitch circle, $P_M$, and female pitch circle, $P_F$, meet at a common point called the pitch point and have a common tangent at the pitch point. At any contact point between the male and female rotor profiles, or conjugate profiles, a common normal can be drawn between the contact point and the pitchpoint. The angle between this common normal at the contact point and the common tangent at the pitchpoint is called pressure angle.

Curve $F_7$–$F_8$ on female rotor 14 is also an involute of a circle at the desired pressure angle. For both rotors, the involute base circle is smaller than but proportional to the pitch circles $P_F$ and $P_M$ of the female rotor 14 and the male rotor 16, respectively. Thus the two involutes are inherently conjugate and one surface need not be generated by the other. Points $F_7$ and $F_8$ are not on the same side of pitch circle, $P_F$, but one of the points can be located on the pitch circle. The transmission of torque between the driving and driven rotors occurs at, or near, the pitch circle with some sliding but primarily with rolling contact between the rotors. Point $F_7$ has been illustrated as located on pitch circle $P_F$.

Curve $M_9$–$M_1$ is a circular arc on the tip circle $T_M$ (bore 12-2) of male rotor 16. Curve $F_9$–$F_1$ on female rotor 14 is generated by curve $M_9$–$M_1$ and represents the path swept out on female rotor 14 by curve $M_9$–$M_1$ as line contact advances from $F_9$ to $F_1$ while both rotors 14 and 16 are rotating at the same pitch circle velocity. Since curve $M_9$–$M_1$ is a circular arc on the tip circle $T_M$ (bore 12-2) of male rotor 16 and is thus centered on the male rotor center B, the resulting curve $F_9$–$F_1$ is also a circular arc which is centered on the female rotor center A and which is the root circle $R_{FR}$ of the female rotor 14. These qualities of curve $F_9$–$F_1$ make it particularly suited for easy generation and inspection which provides better control of the female root for manufacturability.

The curve $M_8$–$M_9$, on male rotor 16 is a curve of variable length and radius which bridges the gap between points $M_8$ and $M_9$, while approaching point $M_9$ at departure angle $\Delta_2$ with respect to a tangent at tip circle $T_M$ (bore 12-2) of male rotor 16. Curve $M_8$–$M_9$ may be a generalized involute or made up of two or more curves such as arcs of circles with different radii. Curve $F_8$–$F_9$ on female rotor 14 is generated by curve $M_8$–$M_9$, and represents the path swept out on female rotor 14 by curve $M_8$–$M_9$ as line contact advances from $F_8$ to $F_9$, while both of rotors 14 and 16 are rotating at the same pitch circle velocity.

Alternatively, the curve $F_8$–$F_9$ on female rotor 14 may be a curve of variable length and radius which bridges the gap between points $F_8$ and $F_9$ while approaching point $F_9$ at an angle which will control departure angle $\Delta_2$ with respect to a tangent at tip circle $T_M$ (bore 12-2) of male rotor 16 at point $M_9$. Curve $F_8$–$F_9$ may be a generalized involute or made up of two or more curves such as arcs of circles with different radii. Curve $M_8$–$M_9$ on male rotor 16 is generated by alternative curve $F_8$–$F_9$ and represents the path swept out on male rotor 16 by alternative curve $F_8$–$F_9$ as line contact advances from $M_8$ to $M_9$ while both rotors 14 and 16 are rotating at the same pitch velocity.

The curves $F_5''$–$F_6$, $M_5'$–$M_6$, $F_6$–$F_7$, $M_6$–$M_7$, $M_8$–$M_9$, and $F_8$–$F_9$ coact to provide control of the pressure angle independently of other profile variables such as female and male departure angles $\Delta_1$ and $\Delta_2$, respectively, and the female lobe thickness, t, among others.

Figure 4:
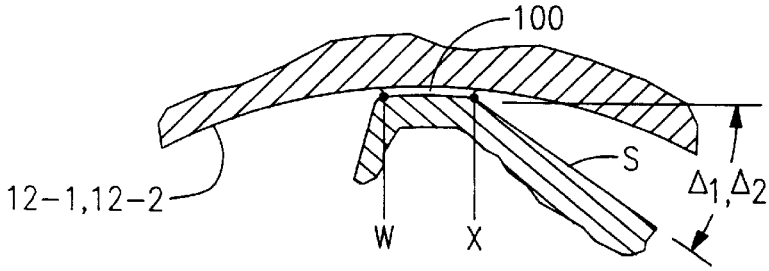
FIG. 4 is an enlarged representation of the departure segment of the rotors of the present invention.

Referring now to FIG. 4, points W and X would correspond to points $F_5$ and $F_5'$ of female rotor 14 and points $M_1$ and $M_9$ of male rotor 16, respectively. The departure angle $\Delta_1$ for female rotor 14 and $\Delta_2$ for male rotor 16 is located between a tangent to curve W-X at point X and the departure segment S which is the portion of rotor 14 or 16 starting at point X and corresponding to line $F_5''$–$F_6$ on female rotor 14 and curve $M_8$–$M_9$ on male rotor 16. It will be noted that departure segment S moves rapidly away from the bore which will be 12-1 for rotor 14 and 12-2 for rotor 16. Accordingly, since oil film 100 is dependent upon a close distance between adjacent parts, its length is reduced and restricted essentially to the region of small clearance which essentially corresponds to the surface defined between W and X and a little past X. The reduced length of oil film 100 results in a reduced viscous shear stress area and thus reduced overall drag.

Figure 5:
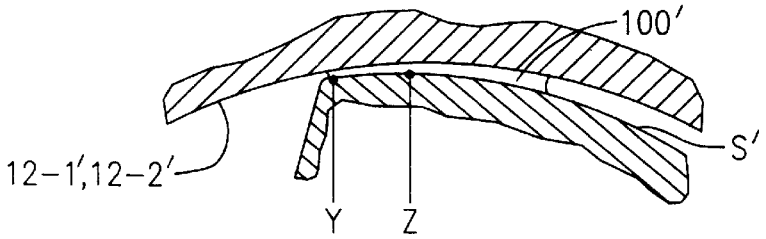
FIG.5 Prior Art
FIG. 5 is an enlarged representation of the departure segment of the rotors of a PRIOR ART device.

Referring now to FIG. 5, points Y and Z correspond to points W and X in FIG. 4. Departure segment S' has a PRIOR ART configuration and starts essentially tangent to, and for considerable distance remains close to, the rotor bore 12-1', 12-2'. The oil film 100' which develops is much longer than oil film 100 and results in a greater viscous drag as the rotor tip moves relative to the bore as compared to the configuration of FIG. 4.

As noted above, the present invention permits control of the pressure angle independently of other profile variables such as female and male departure angles $\Delta_1$ and $\Delta_2$, respectively, and the female lobe thickness, t, among others. Accordingly, the rotor profiles described above may be modified in order to achieve a desired design feature.

Segment $F_5''$–$F_6$ of FIG. 2 is described above as a straight line or a curve of infinite radius. In reality, taking manufacturing tolerances and the length of $F_5''$–$F_6$ into account, there would be no practical difference if $F_5''$–$F_6$ is a straight line or a curved segment where the radius is very large, and there would be no perceived difference in the drawings in the absence of distortion at a very greatly magnified scale. Segment $F_5''$–$F_6$ becomes a point where there is tangency with the tip circle at $F_5''$ and where $\Delta_1$ becomes 0°.

Figure 6:
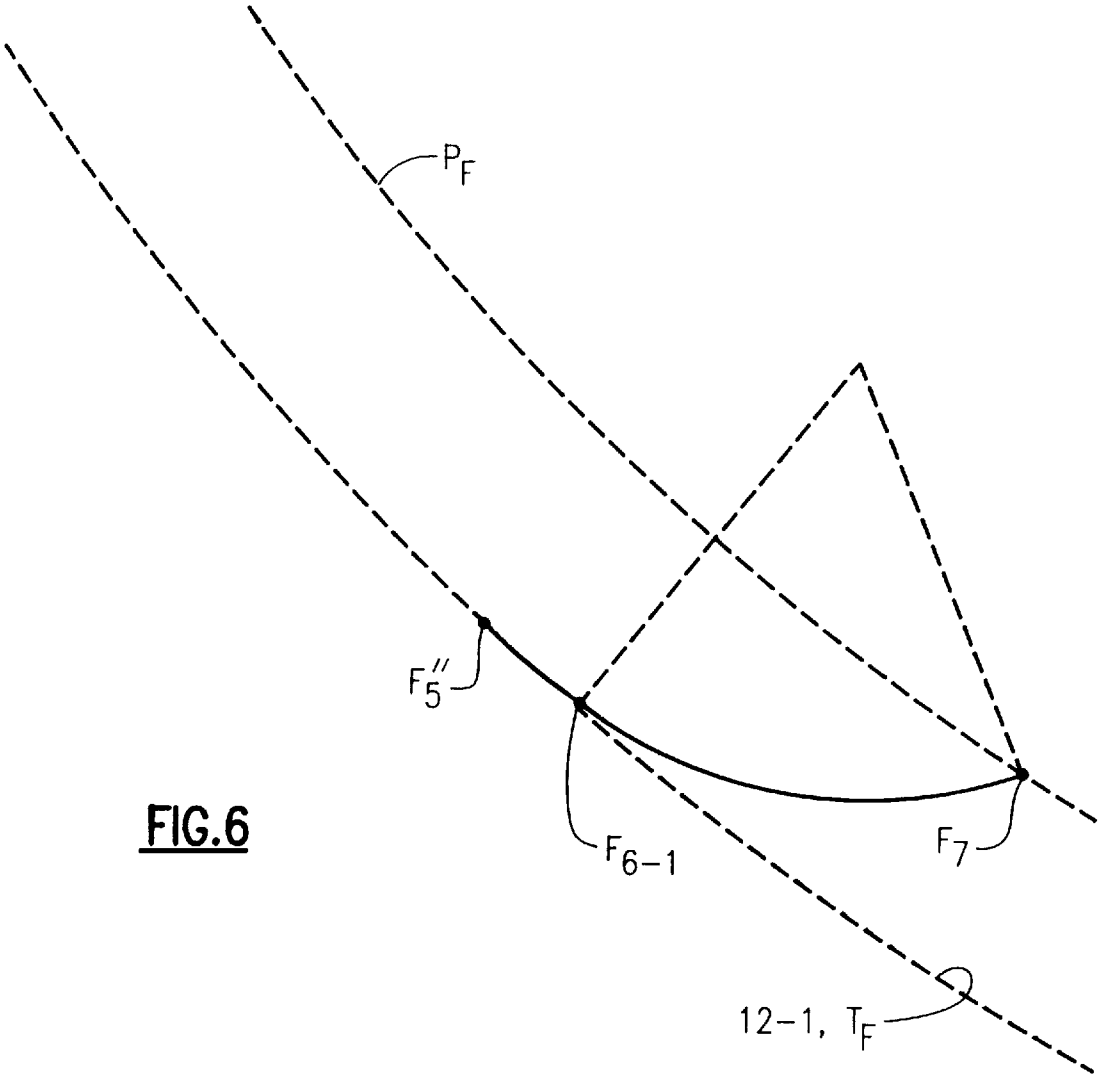
FIG. 6 is an enlarged portion of a modified segment of a female rotor.

Referring now to FIG. 6, straight or very large radius segment $F_5''$–$F_6$ has been replaced by large radius segment $F_5''$–$F_{6\text{-}1}$ which is tangent to female rotor tip circle $T_F$ (bore 12-1) at $F_5''$. Curved segment $F_{6\text{-}1}$–$F_7$ is of a smaller radius than curved segment $F_5''$–$F_{6\text{-}1}$. The advantage of this embodiment is that $\Delta_1$, the female rotor departure angle is made 0° while still allowing for independent control of the pressure angle and the female lobe thickness, t. Segments $F_5''$–$F_{6\text{-}1}$ and $F_{6\text{-}1}$–$F_7$ will generate modified segments corresponding to $M_5'$–$M_6$ and $M_6$–$M_7$, respectively, on male rotor 16 as described with respect to FIGS. 1–3.

Figure 7:
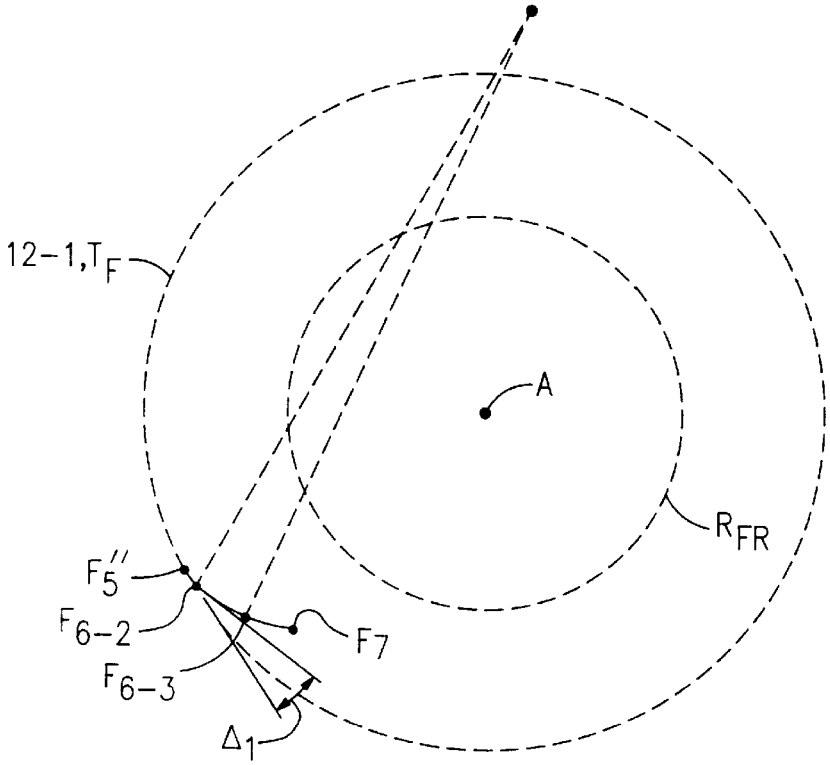
FIG. 7 is an enlarged portion of a second modified segment of a female rotor.

FIG. 7 illustrates a second modified female rotor profile. Specifically, points $F_5''$ and $F_7$ are connected through three curved segments, rather than two segments. Segment $F_5''$–$F_{6\text{-}2}$ is a small radius portion intersecting the female rotor tip circle $T_F$ (bore 12-1). Segment $F_{6\text{-}2}$–$F_{6\text{-}3}$ is a large radius segment and segment $F_{6\text{-}3}$–$F_7$ is a small radius segment. The angle $\Delta_1$ is the female rotor departure angle and is measured between a tangent to point $F_{6\text{-}2}$ and the female rotor tip circle $T_F$ (bore 12-1). Segments $F_5''$–$F_{6\text{-}2}$, $F_{6\text{-}2}$–$F_{6\text{-}3}$ and $F_{6\text{-}3}$–$F_7$ will generate modified segments to the portion between $M_5'$ and $M_7$ on male rotor 16. The advantage of the embodiment of FIG. 7 is the elimination of the sharp comer at $F_5''$ which otherwise might be difficult to produce with certain manufacturing processes such as finish milling or grinding of the lobes and tip diameter in a single operation.

Figure 8:
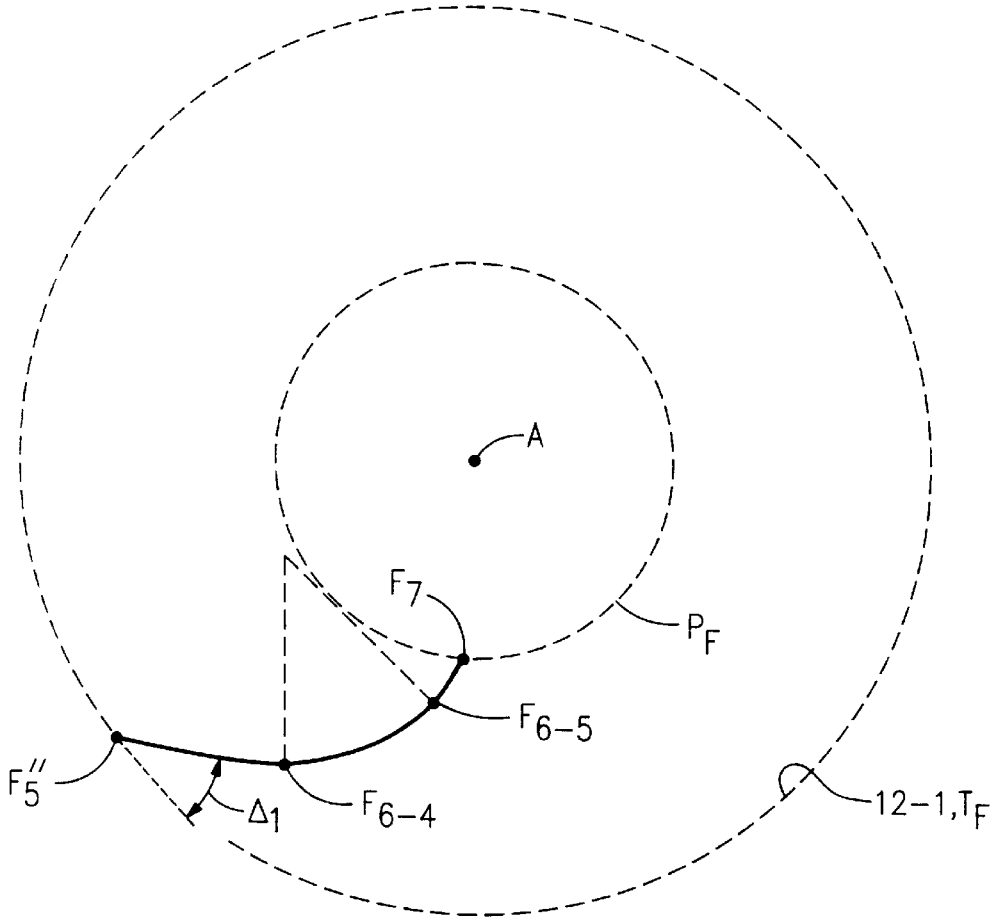
FIG. 8 is an enlarged portion of a third modified segment of a female rotor.

FIG. 8 illustrates a third modified female rotor profile. Specifically, points $F_5''$ and $F_7$ are connected through three curved segments. Segment $F_5''$–$F_{6\text{-}4}$ is a large radius portion intersecting the female rotor tip circle $T_F$ (bore 12-1). Segment $F_{6\text{-}4}$–$F_{6\text{-}5}$ is a curved segment having a smaller radius than segment $F_5''$–$F_{6\text{-}4}$. Segment $F_{6\text{-}5}$–$F_7$ is a curved segment having a smaller radius than segment $F_{6\text{-}4}$–$F_{6\text{-}5}$. Segments $F_5''$–$F_{6\text{-}4}$, $F_{6\text{-}4}$–$F_{6\text{-}5}$ and $F_{6\text{-}5}$–$F_7$ will generate modified segments corresponding to the portion between $M_5'$ and $M_7$ on male rotor 16. The advantage of the embodiment of FIG. 8 is the increased flexibility in the independent selection of female lobe thickness, pressure angle and the radius of segments $F_{6\text{-}4}$–$F_{6\text{-}5}$ and $F_{6\text{-}5}$–$F_7$ which replace segment $F_6$–$F_7$ in the FIG. 2 embodiment and which may be restricted in certain desired ranges based on manufacturing requirements.

Figure 9:
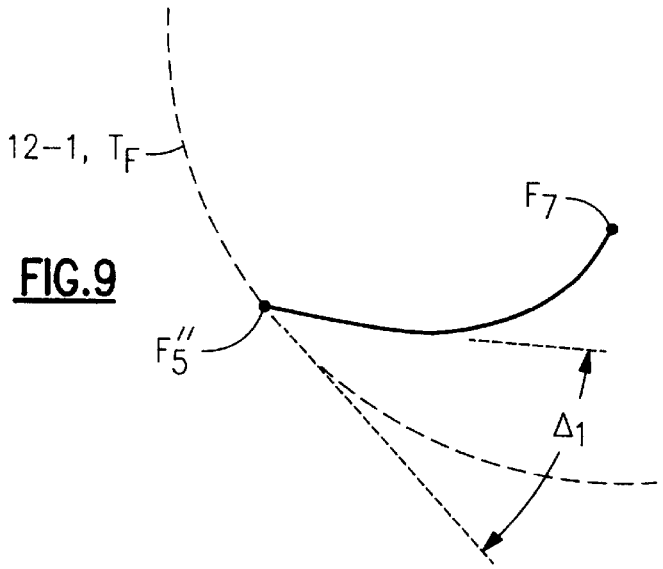
FIG. 9 is an enlarged portion of a fourth modified segment of a female rotor.

FIG. 9 illustrates a fourth modified female rotor profile. Specifically, points $F_5''$ and $F_7$ are connected through a single varying radius curve, such as an involute, which reduces in radius in going from point $F_5''$ to point $F_7$. Segment $F_5''$–$F_7$ will generate a modified segment corresponding to the portion between $M_5'$ and $M_7$ on male rotor 16. The advantage of the embodiment of FIG. 9 is the extension of the width of the contact band where a constant pressure angle is maintained.

Other variations are the cases where either curve $M_8$–$M_9$ or curve $F_8$–$F_9$ is made up of two or more curves, one of said curves may be located on a portion of curve $M_8$–$M_9$ and another of said curves may be located on curve $F_8$–$F_9$, both of said curves being located so as not to be conjugate with each other.

Figure 10:
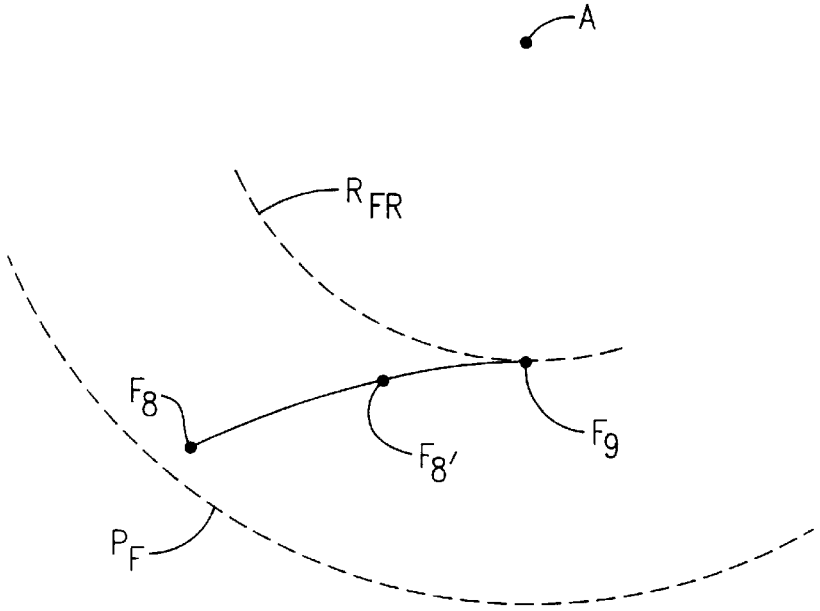
FIG. 10 is an enlarged portion of a fifth modified segment of a female rotor.

FIG. 10 illustrates a fifth modified female rotor profile. Specifically, points $F_8$ and $F_9$ are connected through two curves. The two curves are $F_8$–$F_8'$ and $F_8'$–$F_9$ which are each arcs of circles. Segments $F_8$–$F_8'$ and $F_8'$–$F_9$ will coact to generate a modified segment corresponding to segment $M_8$–$M_9$ on male rotor 16. The advantage of the embodiment of FIG. 10 is an alternate method of generating curves $F_8$–$F_9$ and $M_8$–$M_9$ of FIGS. 2 and 3, respectively, by substituting simplified arcs of circles on the female rotor in place of the more complex generalized involute.

Figure 11:
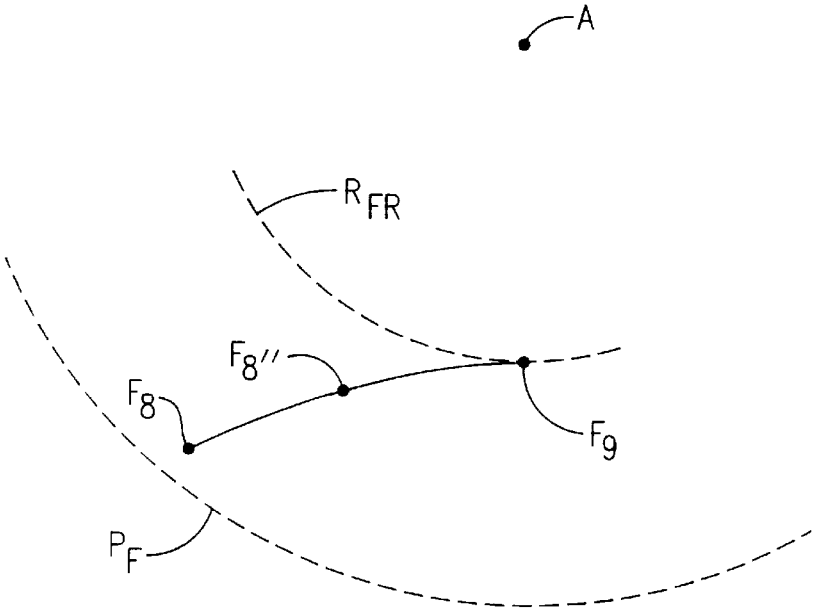
FIG. 11 is an enlarged portion of a sixth modified segment of a female rotor.

FIG. 11 illustrates a sixth modified female rotor profile. Specifically, points $F_8$ and $F_9$ are connected through two curves. The two curves are $F_8$ –$F_8''$ which is a curve of continuously varying radius, such as an involute, and $F_8''$–$F_9$ which is an arc of a circle. Segments $F_8$–$F_{8''}$and $F_{8''}$–$F_9$ coact to generate a modified segment $M_8$–$M_9$ on male rotor 16. The advantage of the embodiment of FIG. 11 is an alternate method of generating curves $F_8$–$F_9$ and $M_8$–$M_9$ of FIGS. 2 and 3 by substituting a simplified arc of a circle and a lower order involute on the female rotor in place of the more complex generalized involute.

Figure 12:
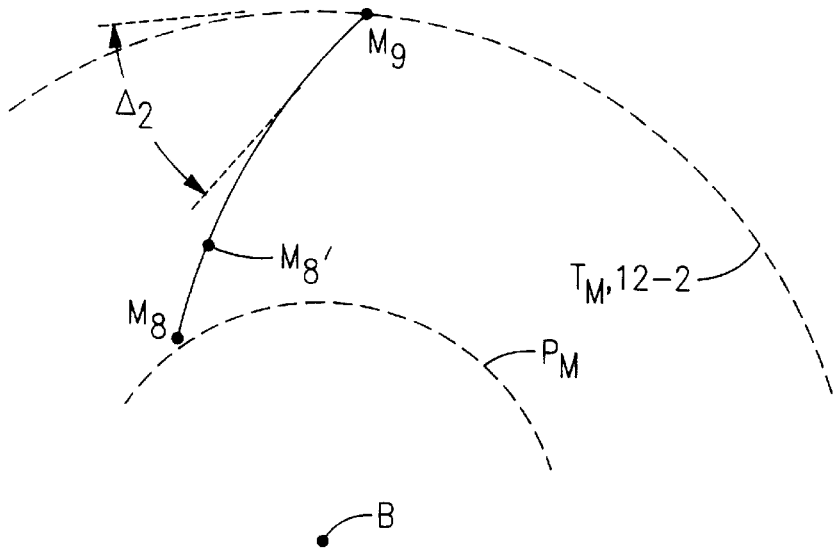
FIG. 12 is an enlarged portion of a first modified segment of a male rotor.

FIG. 12 illustrates a first modified male rotor profile. Specifically, points $M_8$ and $M_9$ are connected through two curves. Curves $M_8$–$M_8'$ and $M_8'$–$M_9$ are each arcs of circles tangent at their common point $M_8'$. The advantage of the embodiment of FIG. 12 is an alternate method of generating curves $F_8$–$F_9$ and $M_8$–$M_9$ of FIGS. 2 and 3 by substituting simplified arcs of circles on the male rotor in place of the more complex generalized involute.

Figure 13:
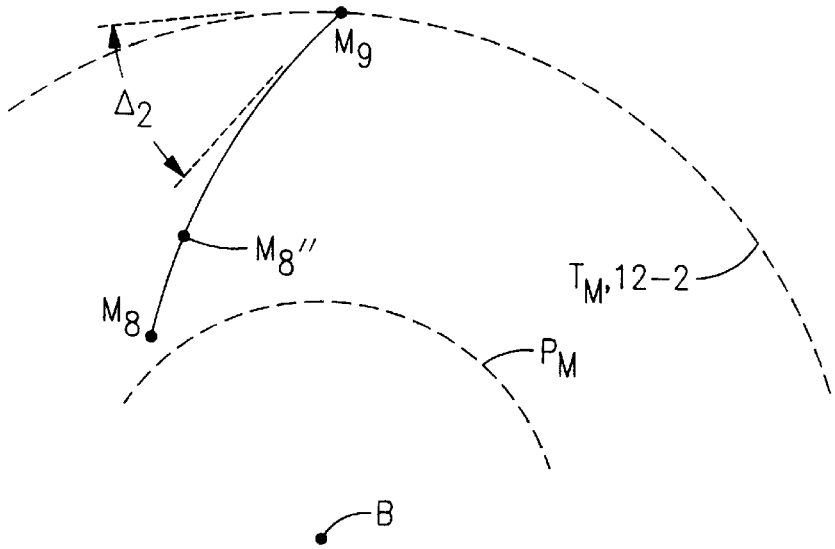
FIG. 13 is an enlarged portion of a second modified segment of a male rotor.

FIG. 13 illustrates a second modified male rotor profile. Specifically, points $M_8$ and $M_9$ are connected through two curves. Curve $M_8$ and $M_8''$ is an arc of a circle and curve $M_8''$–$M_9$ is a curve of continuously varying radius such as an involute. The two curves are tangent at their common point $M_8''$. The advantage of the embodiment of FIG. 13 is an alternate method of generating curves $F_8$–$F_9$ and $M_8$–$M_9$ of FIGS. 2 and 3 by substituting a simplified arc of a circle and a lower order of involute on the male rotor in place of the more complex generalized involute.

Figure 14:
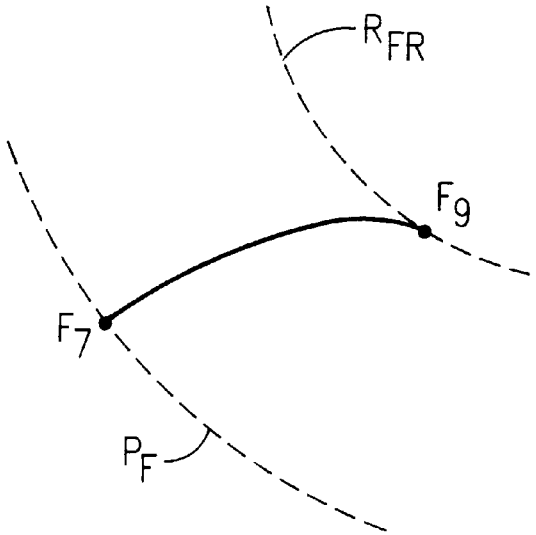
FIG. 14 is an enlarged portion of a seventh modified segment of a female rotor.
Figure 15:
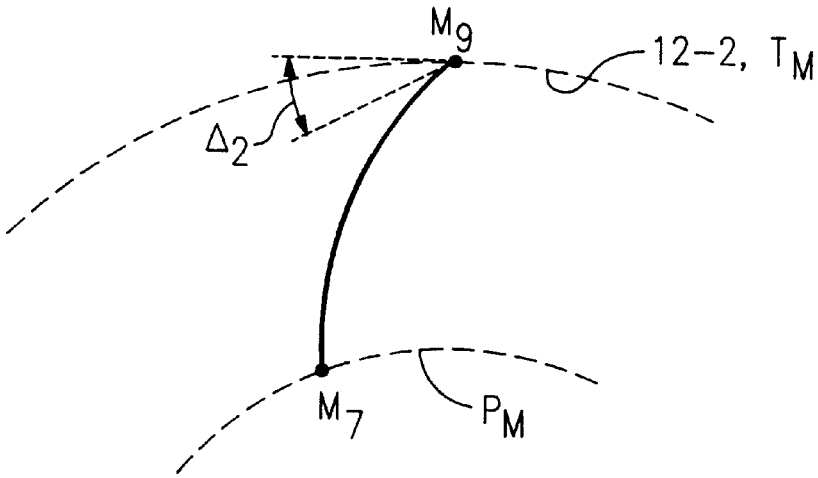
FIG. 15 is an enlarged portion of a third modified segment of a male rotor which is conjugate to the FIG. 14 configuration.

FIGS. 14 and 15 depict conjugate segments on a female and male rotor, respectively. The FIG. 14 modification differs from the FIG. 2 embodiment in that points $F_7$ and $F_9$ are connected through a single curve of continuously varying radius, such as a generalized involute. Similarly, the FIG. 15 modification differs from the FIG. 3 embodiment in that points $M_7$ and $M_9$ are connected through a single curve of continuously varying radius, such as a generalized involute. The advantage of the embodiments of FIGS. 14 and 15 is the elimination of the transition at the points $F_8$ and $M_8$ and the associated sudden change in radius of curvature which in some cases might otherwise add complexity to the design.

Although preferred embodiments of the present invention have been illustrated and described, other changes will occur to those skilled in the art. It is therefore intended that the scope of the present invention is to be limited only by the scope of the appended claims.

What is claimed is:

1. A conjugate pair of intermeshing rotors having helical lobes comprising helical crests and intervening grooves and adapted for rotation about parallel axes within a working space of a screw rotor machine, each rotor has a tip circle, a pitch circle, and a root circle, one rotor of each pair being a female rotor such that the major portion of each lobe of said female rotor is located inside said pitch circle of said female rotor, the other rotor being a male rotor is located outside said pitch circle of said male rotor, the lobes of one rotor following the grooves of the other rotor to form a continuous sealing line between said pair of rotors, a first portion of each female lobe located generally between the tip circle and pitch circle of said female rotor containing a first segment having a large radius portion ($F_5''$–$F_6$) nearer said tip circle and said female rotor and a smaller radius portion ($F_6$–$F_7$) nearer said pitch circle of said female rotor, wherein said large radius potion of said segment intersects the tip circle of said female rotor at an angle other than 0°.

2. The rotors of claim 1 wherein said large radius portion is infinite such that said large radius portion defines a straight line.

3. The rotors of claim 1 wherein said large radius portion of said segment intersects the tip circle of said female rotor and is tangent to the tip circle of said female rotor at the point of intersection.

4. The rotors of claim 1 wherein said large radius portion of said segment intersects a small radius portion which is located between said large radius portion of said segment and said tip circle of said female rotor and which intersects the tip circle of said female rotor.

5. The rotors of claim 1 wherein said smaller radius portion of said segment intersects said pitch circle of said female rotor.

6. The rotors of claim 1 wherein said smaller radius portion of said segment intersects another portion which is located between said smaller radius portion of said segment and said pitch circle of said female rotor and which intersects said pitch circle of said female rotor.

7. The rotors of claim 1 wherein said female lobes additionally include a circular portion coincident with said female rotor tip circle and said male lobes additionally include a circular portion coincident with said male rotor root circle and which is conjugate with said female lobe circular portion.

8. The rotors of claim 1 wherein said male lobes additionally include a circular portion coincident with said male rotor tip circle and said female lobes additionally include a circular portion coincident with said female rotor root circle and which is conjugate with said male circular portion.

9. A conjugate pair of intermeshing rotors having helical lobes comprising helical crests and intervening grooves and adapted for rotation about parallel axes within a working space of a screw rotor machine, each rotor has a tip circle, a pitch circle, and a root circle, one rotor of each pair bring a female rotor such that the major portion of each lobe of said female rotor is located inside said pitch circle of said female rotor, the other rotor being a male rotor is located outside said pitch circle of said male rotor, the lobes of one rotor following the grooves of the other rotor to form a continuous sealing line between said pair of rotors, a first portion of each female lobe located generally between the tip circle and pitch circle of said female rotor containing a first segment having a large radius portion ($F_5''$–$F_6$) nearer said tip circle and said female rotor and a smaller radius portion ($F_6$–$F_7$) nearer said pitch circle of said female rotor, wherein a second portion of each female rotor lobe is located generally between said female rotor pitch circle and said female rotor root circle and characterized by having a varying radius and the conjugate portion on said male rotor is also characterized by having a varying radius.

10. The rotors of claim 9 wherein said second portion of varying radius on said female rotor contains two or more different arcs of circles.

11. The rotors of claim 9 wherein said conjugate portion of varying radius on said male rotor contains two or more different arcs of circles.

12. The rotors of claim 9 wherein said second portion of varying radius on said female rotor contains at least one arc of a circle and one portion of continuously varying radius.

13. The rotors of claim 12 wherein said portion of continuously varying radius on said female rotor is conjugate with an arc of a circle on said male rotor.

14. The rotors of claim 9 wherein said conjugate portion of varying radius on said male rotor contains at least one arc of a circle and one portion of continuously varying radius.

15. The rotors of claim 14 wherein said portion of continuously varying radius on said male rotor is conjugate with an arc of a circle on said female rotor.

16. The rotors of claim 9 wherein said second portion of varying radius of said female rotor is continuously varying and said conjugate portion of varying radius on said male rotor is also continuously varying.

17. The rotors of claim 9 wherein said female lobes additionally include a circular portion coincident with said female rotor tip circle and said male lobes additionally include a circular portion coincident with said male rotor root circle and which is conjugate with said female circular portion.

18. The rotors of claim 9 wherein said male lobes additionally include a circular portion coincident with said male rotor tip circle and said female lobes additionally include a circular portion coincident with said female rotor root circle and which is conjugate with said male circular portion.

19. A conjugate pair of intermeshing rotors having helical lobes comprising helical crests and intervening grooves and adapted for rotation about parallel axes within a working space of a screw rotor machine, each rotor has a tip circle, a pitch circle, and a root circle, one rotor of each pair being a female rotor such that the major portion of each lobe of said female rotor is located inside said pitch circle of said female rotor, the other rotor being a male rotor is located outside said pitch circle of said male rotor, the lobes of one rotor following the grooves of the other rotor to form continuous sealing line between said pair of rotors, a first portion of each female lobe located generally between the tip circle and pitch circle of said female rotor containing a first segment having a large radius portion ($F_5''$–$F_6$) nearer said tip circle and said female rotor and a smaller radius portion ($F_6$–$F_7$) nearer said pitch circle of said female rotor, wherein said female rotors are further characterized by a second segment located inside said female pitch circle and intersecting tangentially with said female root circle and having a varying radius which is selected such that the corresponding conjugate segment on said male lobe also has a varying radius.

20. The rotors of claim 19 wherein said first and second segments on said female rotor are continuous.

21. The rotors of claim 19 wherein a third segment is located between and joins said first segment and said second segment.

22. The rotors of claim 19 wherein said first segment intersects said female tip circle at a tangent.

23. The rotors of claim 19 wherein said first segment intersects said female tip circle at an angle.

24. The rotors of claim 19 wherein said corresponding conjugate segment on said male lobe which is conjugate to said second segment on said female lobe intersects said male tip circle at an angle.

25. The rotors of claim 24 wherein said angle is 0°.

26. The rotors of claim 19 wherein said female lobes additionally include a circular portion coincident with said female tip circle and said male lobes additionally include a circular portion which is coincident with said male root circle and conjugate with said female circular portion which is coincident with said female tip circle.

27. The rotors of claim 19 wherein said male lobes additionally include a circular portion coincident with said male tip circle and said female lobes additionally include a circular portion which is coincident with said female root circle and conjugate with said male circular portion which is coincident with said male tip circle.

28. The rotors of claim 19 wherein said second segment on said female rotor and said conjugate male segment collectively include at least two portions consisting of circular arcs.

29. The rotors of claim 19 wherein said second segment on said female rotor and said corresponding conjugate male segment both are of continually varying radius.

30. The rotors of claim 19 wherein said first segment on said female rotor contains at least one portion having an infinite radius.

31. A conjugate pair of intermeshing rotors having helical lobes comprising helical crests and intervening grooves and adapted for rotation about parallel axes within a working space of a screw rotor machine, each rotor has a tip circle, a pitch circle, and a root circle, one rotor of each pair being a female rotor such that the major portion of each lobe of said female rotor is located inside said pitch circle of said female rotor, the other rotor being a male rotor formed such that the major portion of each lobe of said male rotor is located outside said pitch circle of said male rotor, the lands of one rotor following the grooves of the other rotor to form a continuous sealing line between said pair of rotors, said lobes on said female rotor comprising at least eight segments, said lobes on said male rotor comprising at least eight segments which are conjugate to said female rotor segments, respectively, said female rotor segments starting at a first point coincident with a point on the female root circle and said conjugate male rotor segments starting at a corresponding first point coincident with a point on the male tip circle, said segments being characterized by:

a first segment on said male rotor comprising solely said first point only on said tip circle of said male rotor, and a first segment on said female rotor extending from said first female point on said female root circle to a second point radially inward of said female pitch circle and which is generated by said first point on male rotor when both of said rotors are rotated at the same pitch velocity;

a second segment on said female rotor comprising a circular arc extending from the said second female rotor point and extending to a third point located radially outward at least to said pitch circle of said female rotor, and a second segment on said male rotor extending between said first male rotor point and a second male rotor point and which is generated by said second female segment when both of said rotors are rotated at the same pitch velocity;

a third segment on said female rotor comprising a circular arc extending from said third female rotor point and extending to a fourth point located between said female rotor tip circle and said female rotor pitch circle and a third segment on said male rotor extending from said second male rotor point to a third male rotor point and which is generated by said third female segment when both of said rotors are rotated at the same pitch circle velocity;

a fourth segment on said female rotor comprising a circular arc extending from said fourth female rotor point and extending to a fifth female rotor point which is coincident with a point on said female tip circle, and a fourth segment on said male rotor extending from said third male rotor point to a fourth male rotor point which is coincident with a point on said male root circle, and said fourth male rotor segment which is generated by said fourth female segment when both of said rotors are rotated at the same pitch circle velocity;

a fifth segment on said female rotor comprising a circular arc coincident with said female rotor tip circle and extending from said fifth female rotor point to a sixth female rotor point, and a fifth segment on said male rotor extending from said fourth male rotor point to a fifth male rotor point and which is generated by said fifth female segment when both of said rotors are rotated at the same pitch circle velocity;

a sixth segment on said female rotor which extends from said sixth female rotor point on said tip circle of said female rotor to a seventh female rotor point located on or radially outward of said female rotor pitch circle comprising a curve of generally large radius in the outward end nearer said female rotor tip circle and having a generally smaller radius in the inward end nearer said female rotor pitch circle, and a sixth segment on said male rotor extending from said fifth male rotor point to a sixth male rotor point and which is generated by said sixth female segment when both of said rotors are rotated at the same pitch circle velocity;

a seventh segment on said male rotor which extends from said sixth male rotor point to an seventh male rotor point which is coincident with a point on said tip circle of said male rotor and said seventh male rotor segment comprising a curve characterized by having a varying radius, and a seventh segment on said female rotor which extends from said seventh female rotor point to an eighth female rotor point which is coincident with a point on said female root circle and at least a portion of said eighth female rotor segment being generated by at least a portion of said seventh male rotor segment when both of said rotors are rotated at the same pitch circle velocity;

an eighth segment on said male rotor comprising a circular arc coincident with said male tip circle and extending from said seventh male rotor point to an eight male rotor point which is coincident with said first male rotor point for the subsequent male lobe, and an eighth segment on said female rotor extending from said eight female rotor point to a ninth female rotor point which is coincident with said first female rotor point for a subsequent female lobe, said eighth female rotor segment being generated by said eighth male rotor segment when both of said rotors are rotated at the same pitch circle velocity.

32. The rotors of claim 31 wherein said generally large radius of said sixth female rotor segment is essentially infinite and defines a straight line.

33. The rotors of claim 32 wherein said straight line intersects said female rotor tip circle at an angle at said sixth female rotor point of said female rotor.

34. The rotors of claim 31 wherein said generally large radius of said sixth female rotor segment intersects said female tip circle at said sixth female rotor point and is tangent to said female tip circle at said point of intersection.

35. The rotors of claim 31 wherein said generally large radius of said sixth female rotor segment intersects said female tip circle at an angle at said sixth female rotor point.

36. The rotors of claim 31 wherein said sixth segment on said female rotor further includes a small radius portion interposed between said fifth female rotor segment and said curve of generally large radius.

37. The rotors of claim 31 wherein said seventh female rotor segment contains two or more different arcs of circles.

38. The rotors of claim 37 in which said seventh female rotor segment additionally contains a portion which is an involute of a circle.

39. The rotors of claim 31 wherein said seventh male rotor segment contains two or more different arcs of circles.

40. The rotors of claim 39 in which said seventh male rotor segment of varying additionally contains a portion which is an involute of a circle.

41. The rotors of claim 39 wherein said seventh female rotor segment contains at least one arc of a circle and one portion of continuously varying radius.

42. The rotors of claim 41 in which said portion of continuously varying radius in said seventh female rotor segment is an involute of a circle.

43. The rotors of claim 41 wherein said portion of continuously varying radius of seventh female rotor segment is conjugate with an arc of a circle on said seventh male rotor segment of varying radius.

44. The rotors of claim 43 in which said portion of continuously varying radius of said seventh female rotor segment which is an involute of a circle.

45. The rotors of claim 39 wherein said seventh male rotor segment portion further includes at least one arc of a circle.

46. The rotors of claim 45 wherein said eighth female rotor segment includes an arc of a circle and said seventh male rotor segment of continuously varying radius is conjugate with said arc of a circle on said eighth segment on said female rotor.

47. The rotors of claim 31 wherein the radius of seventh male rotor segment of varying radius includes at least a portion which is continuously varying and the radius of said seventh female rotor segment includes at least a portion which is continuously varying.

* * * * *